US007597632B2

(12) United States Patent
Edwards et al.

(10) Patent No.: US 7,597,632 B2
(45) Date of Patent: Oct. 6, 2009

(54) GOLF PUTTING PRACTICE AID

(76) Inventors: Stephen J. Edwards, 4829 Frost Hollow Dr., Plano, TX (US) 75093; Carlos G. Moreno, 1933 Cheyenne Dr., Carrollton, TX (US) 75010

( * ) Notice: Subject to any disclaimer, the term of this patent is extended or adjusted under 35 U.S.C. 154(b) by 134 days.

(21) Appl. No.: 11/152,306

(22) Filed: Jun. 14, 2005

(65) Prior Publication Data

US 2005/0215342 A1 Sep. 29, 2005

(51) Int. Cl.
*A63B 69/36* (2006.01)

(52) U.S. Cl. ..... 473/265; 473/257

(58) Field of Classification Search ..... 473/219, 473/238, 257, 258, 261, 264, 265
See application file for complete search history.

(56) References Cited

U.S. PATENT DOCUMENTS

| | | | | |
|---|---|---|---|---|
| 3,806,133 | A | 4/1974 | Cork | |
| 4,437,669 | A | 3/1984 | Pelz | |
| 4,852,881 | A * | 8/1989 | Bellagamba et al. | 473/216 |
| 4,900,030 | A | 2/1990 | Houtz | |
| 4,928,975 | A | 5/1990 | Skelley et al. | |
| 4,998,731 | A * | 3/1991 | Bowen | 473/271 |
| 5,209,484 | A | 5/1993 | Randall | |
| 5,303,926 | A * | 4/1994 | Owens et al. | 473/261 |
| 5,433,445 | A * | 7/1995 | Melancon | 473/261 |
| 5,586,945 | A | 12/1996 | Vonderhaar | |
| 5,707,300 | A | 1/1998 | May et al. | |
| 5,769,732 | A | 6/1998 | O'Neal | |
| 5,816,932 | A * | 10/1998 | Alexander | 473/259 |
| 5,823,591 | A | 10/1998 | Rubinstein | |
| 5,997,410 | A | 12/1999 | Nothdurft | |
| 6,322,456 | B1 * | 11/2001 | Benggon | 473/219 |
| 6,364,786 | B1 * | 4/2002 | Khano | 473/257 |
| 6,572,486 | B2 | 6/2003 | Sweinhart | |
| 6,729,968 | B2 | 5/2004 | Port et al. | |

* cited by examiner

*Primary Examiner*—Nini Legesse
(74) *Attorney, Agent, or Firm*—Dennis T. Griggs; Scott T. Griggs; Griggs Bergen LLP

(57) ABSTRACT

A golf putting practice aid has a rectangular base frame that serves as a stroke window for shot set-up and aiming purposes. A side frame is movably mounted on the base frame for pivotal movement from a folded, minimum profile storage configuration to an upright operative putting position. The side frame includes an elongated guide bar disposed in parallel alignment with the longitudinal axis of the stroke window for engaging and guiding pendulum movement of a putter shaft during execution of a putting stroke. The slope angle of the side frame relative to the base frame, and thus the elevation of the guide bar, is manually adjustable to suit the golfer's personal swing preference and putter selection. The guide bar and one of the base rails are marked with colored bands for indicating back swing stroke range and follow-through stroke range.

2 Claims, 3 Drawing Sheets

GOLF PUTTING PRACTICE AID

BACKGROUND OF THE INVENTION

1. Field of the Invention

This invention is related generally to golfing equipment, and in particular to puffing practice and training aids.

2. Description of the Related Art

Golf is an outdoor game in which individual players use specially designed clubs to propel a small, hard ball over a field of play known as a golf course. The object of the game is to place the ball in each hole and advance the ball around the course in sequence using as few strokes as possible.

The modern rules of golf play are numerous and complex and include specific limitations on golfing equipment that may be used on the green. The rules of regulation play are set and maintained in the U.S. by the United States Golf Association (USGA). The USGA also establishes the standards for the mechanical aspects of the game, for example the number of holes, the size of the cup required for regulation play, the size and hardness of the ball, club construction, and restrictions on the use of mechanical aids.

A conventional golf course is divided into 18 sections or "links," generally referred to as "holes." The overall course length is about 6,500 to 7,000 yards (about 5,900 to 6,400 m), and the spacing between individual holes, called the fairway, may vary in length from 100 to 600 yards (from 90 to 550 m). Each hole has at one end a starting point known as a tee and, imbedded in the ground at the other end, and marked by a flag, is a cylindrical container called a cup, into which the ball must be placed in order to complete play at each hole. The cup is usually made of metal or plastic, 4.2 inches (10.8 cm) in diameter, and at least 4 inches (10 cm) deep.

Play begins at the first tee, a level area of turf, generally raised slightly above the surrounding terrain. From there each player tries to drive the ball onto the fairway or main part of the golf course, a carefully tended strip of land, 30 to 100 yards (27 to 90 m) wide, on which the grass has been cut to provide a smooth rolling surface for the ball. On either side of the fairway is the rough, which consists of areas covered with long grass, bushes, or trees, and which sometimes contains sandy, rough, or marshy land and artificial hazards, such as ditches, creeks, ponds, or lakes, that compel golfers to use additional skill and judgment in playing their shots.

The putting green, an area of closely cropped grass surrounding the cup, is located at the far end of the fairway. The smooth surface of the putting green is designed to facilitate the rolling progress of the ball into the cup after the ball has been given a gentle stroke, known as a "putt." The putting stroke is only one of several types of golf swings, yet it accounts for nearly half of all swings made during regulation play. Typically, the distance from the edge of the putting green to the cup is variable along a curved boundary, ranging from about 40 feet to about 50 feet. At the beginning of putting green play, the ball lies somewhere in between, with some holes being sunk by a relatively long put from 20 feet to 30 feet out, but with most being sunk after two or more putts in the range of 6 feet to 10 feet to the cup.

Successful golf putting requires an assessment of the slope and grain of the putting green, a feel for the putting distance to the cup, visualization of the probable ball trajectory needed to sink the ball into the cup, and the ability to accurately aim, execute and stroke the putt in a manner that is controllable and repeatable. All of this requires good hand/eye coordination, upper body muscle control, body alignment and mental imagery.

Golf pros and amateurs alike have practiced maintaining correct ball placement, stance, grip, eye contact, and head, arm and shoulder alignment while avoiding excessive body movement during a putting swing or stroke. This is usually performed on a practice green or simulated putting green while a coach observes and provides feedback as to execution. Repetition of these steps allows the golfer to use the "set-up" mental imagery of a model stroke execution that can be recalled and used to guide his play on the putting green, where mechanical aids are not allowed. However, because personal scheduling priorities sometimes conflict with coaching availability, professional coaching is not always an option. For these reasons a mechanical practice aid is needed that can be used to reinforce good putting technique and simplify set-up for putting play.

BRIEF SUMMARY OF THE INVENTION

The invention is based on the insight that putting can be performed essentially as simple pendulum swinging motion, and can be achieved with arms swinging back and forth in a pendulum rhythm. Only the player's shoulders and arms move, and his hips and legs stay still. The player's wrists serve only as clamps holding the putter, without hinging, and shifting of body weight is not required. Because the ideal putting stroke can be modeled as mechanical pendulum swinging movement, the mental calculations needed for putting play set-up are simplified.

The practice aid of the present invention further simplifies set-up by presenting a mechanical guide and visual image framework that allows the golfer to develop muscle memory and mental imagery that are strongly correlated with proper ball placement, true shot alignment, ideal pendulum stroke movement, stroke rhythm, back swing and follow-through. The training aid of the present invention thus reinforces the pendulum stroking technique, and makes possible correct, repeatable putting stroking starting from an objective set-up position that can be recalled from mental imagery and used during regulation play.

The golf putting practice and training apparatus of the present invention is embodied in a lightweight, portable tubular assembly that can be carried as luggage while traveling, and can easily be erected and set-up without tools for practice on any convenient playing surface, such as a commercial practice green, a residential lawn, on outdoor carpet or on indoor carpet in the home or office.

According to the preferred embodiment, the golf putting practice and training apparatus of the present invention includes a base frame with two base rails and two cross bars, the base rails being spaced apart and held substantially in parallel alignment with each other by the cross bars, thereby defining the boundary of an elongated stroke window. An elongated side frame is mounted on the base frame by a rotary friction coupling for pivotal movement relative to the stroke window. The side frame includes a longitudinal guide bar, disposed in parallel alignment with the longitudinal axis of the stroke window, for engaging and guiding linear sliding movement of a putter shaft during execution of a putting stroke.

The slope angle of the side frame relative to the base frame, and thus the elevation of the guide bar, is adjusted to suit the golfer's personal swing preference. An individual golfer, because of personal differences in height and reach, may have his clubs adjusted as to loft and lie angles so that when taking a normal stance while addressing the ball, the club head will be in proper position to strike the ball squarely in the desired direction and with the appropriate loft. The lie angle of a golf club is the acute angle which the club shaft makes with the plane of the sole of the club head. Standard lie angles for irons vary from 56 degrees for a No. 1 iron to 64 degrees for a Nine iron. The adjustment of the guide bar elevation is therefore unique for each individual. This set-up adjustment step is performed by manually rotating the side frame until the guide bar reaches the preferred elevation for accommodating smooth, linear sliding movement of the putter shaft along the guide bar during the execution of a pendulum putting stroke, while also taking the club lie angle into account.

The elevation of the guide bar is adjusted and fixed at an operative putting position such that when the base frame is placed on a putting surface and a golf ball is placed on the longitudinal stroke axis, with the club face square to the ball and the sole of the club head resting flush against the putting surface, the putter shaft engages the guide bar and is inclined relative to the putting surface at an angle equal to its lie angle. In this context, "flush" means that the sole of the putter is disposed in flat or level alignment with the putting surface. Under these set-up conditions, as a putting practice stroke is executed, the head of the putter swings through a pendulum arc, the shaft slides smoothly along the guide bar, the sole of the putter is brought into parallel alignment with the putting surface, and the face of the putter is oriented with a generally neutral loft (zero loft angle) at the moment of impact as the head is stroked against the ball.

In one embodiment, the guide bar is marked with colored bands for indicating back swing stroke range and follow-through stroke range. Preferably, the colored bands are arranged in pairs of identically colored bands that are symmetrically disposed relative to a predetermined central index line or reference point on the guide bar. The index line or reference point corresponds generally with the initial longitudinal placement location of the ball within the stroke window.

In another embodiment, one base rail is marked with symmetrically disposed sets of colored bands for indicating back swing stroke range and follow-through stroke range. In this embodiment, the colored bands are arranged in pairs of identically colored bands that are symmetrically disposed relative to a predetermined central index line or point on the base rail that corresponds generally with the initial longitudinal placement location of the ball within the stroke window.

During initial set-up for putting practice, the longitudinal axis of the stroke window is aligned with the desired trajectory of the golf ball and the slope of the side frame is adjusted to hold the guide bar at the appropriate elevation to accommodate the lie angle of the selected putter. After practice is concluded, the side frame is rotated and folded across the stroke window, thereby providing a minimum profile, collapsed configuration for storage or transport.

The putting practice aid of the present invention permits the golfer to practice his putting stroke independently and at times that meet his personal convenience, while reinforcing good technique as his putting skills evolve. The training apparatus assists the golfer to control upper body movement, while he avoids unnecessary body movement such as hip rotation and hip sway so that energy stored in shoulder muscles during wind-up will be efficiently and accurately transmitted to the golf ball during the down swing and follow-through.

Moreover, the training aid helps the golfer to exercise and train upper body muscles during the execution of a square putting stroke, with smooth follow-through, so that good execution can be performed repeatedly as the muscular training effect is obtained and set-up mental imagery is reinforced by the images provided by the stroke window framework and the colored range bands.

BRIEF DESCRIPTION OF THE SEVERAL VIEWS OF THE DRAWING

The accompanying drawing is incorporated into and forms a part of the specification to illustrate the preferred embodiments of the present invention. Various advantages and features of the invention will be understood from the following detailed description taken with reference to the attached drawing figures, in which.

DETAILED DESCRIPTION OF THE INVENTION

Figure 1:
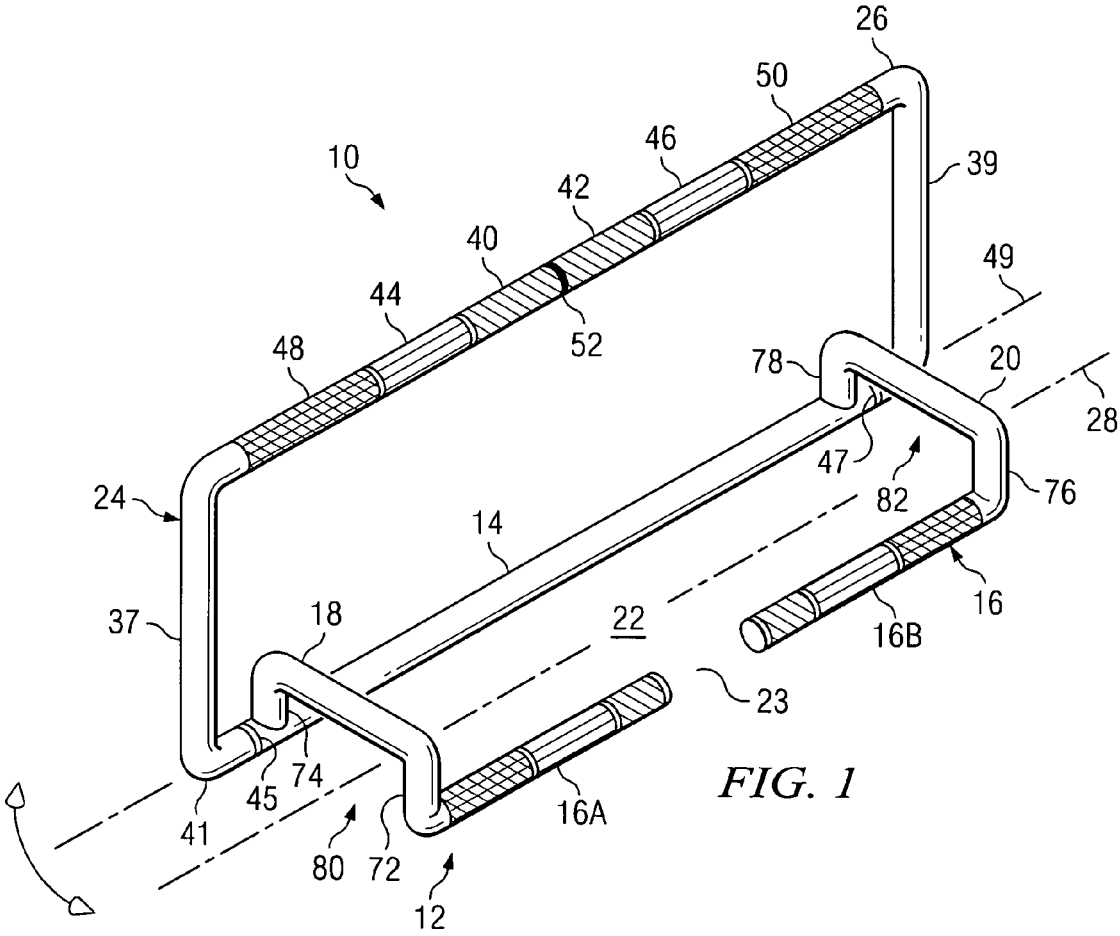
FIG. 1 is a front perspective view of a golf practice and training aid constructed according to the preferred embodiment of the invention.
Figure 2:
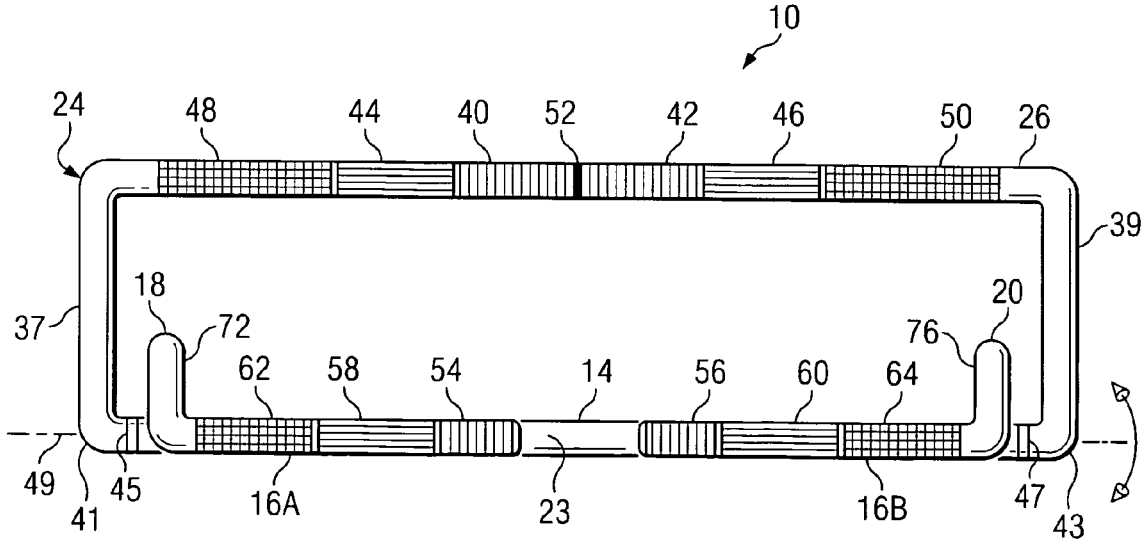
FIG. 2 is a front elevation view thereof.

A preferred embodiment of the invention will now be described with reference to various examples of how the invention can best be made and used. Like reference numerals are used throughout the description and several views of the drawing to indicate like or corresponding parts.

Figure 4:
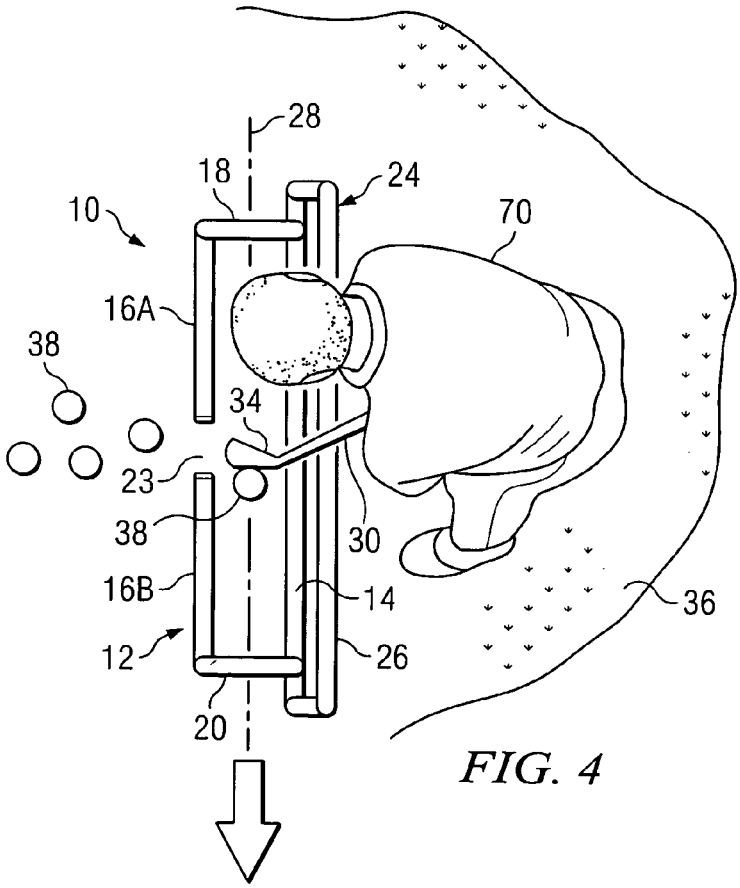
FIG. 4 is a top plan view thereof, showing a golfer addressing a ball within the stroke window.

Referring now to FIG. 1, the golf putting practice and training apparatus 10 of the present invention includes a base frame 12 with two base rails 14, 16 and two cross bars 18, 20. The base rails are spaced apart and held substantially in parallel alignment with each other by the cross bars, thereby defining the boundary of a rectangular stroke window 22. Preferably, the base rail 16 is intersected by a window opening or gap 23. As shown in FIG. 4, the gap 23 allows a group of practice balls to be "raked" or pulled one-by-one from an adjacent standby area on the putting surface into playing position within the stroke window 22.

An elongated side frame 24 is mounted on the base frame for pivotal movement relative to the base frame. The side frame includes a linear guide member in the form of a longitudinal guide bar 26, disposed in parallel alignment with the longitudinal axis 28 of the stroke window, for engaging and guiding linear sliding movement of a putter shaft 30 during execution of a putting stroke. The side frame 24 is coupled to the base frame 12 for pivotal movement by a pair of rotary coupling members 45, 47.

Figure 3:
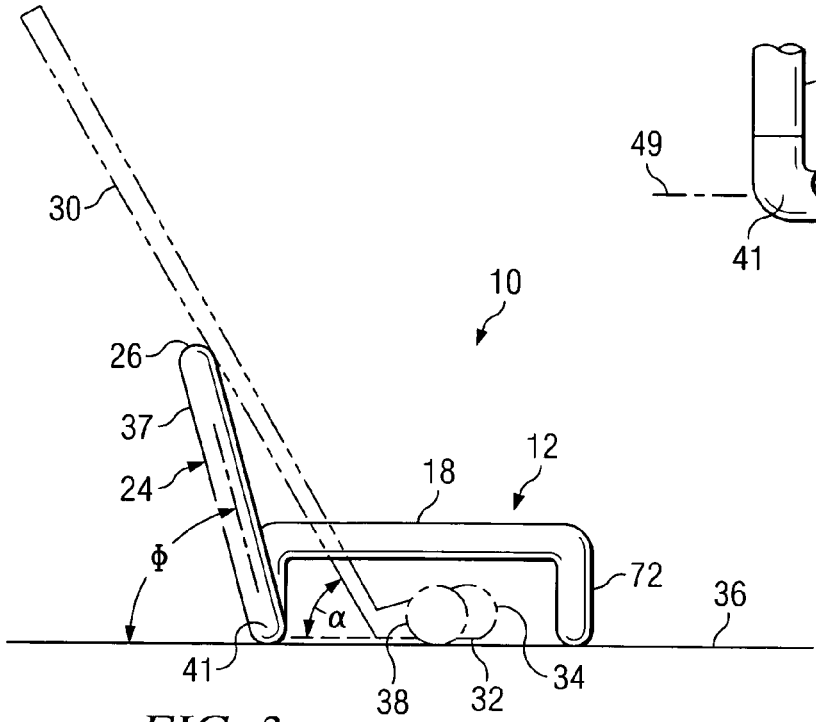
FIG. 3 is a side elevation view thereof showing engagement of a putter shaft against a guide bar.

The slope angle $\phi$ of the side frame relative to the base frame, and thus the elevation of the guide bar 26, is adjusted to suit the golfer's personal swing preference, which is unique for each individual depending on his or her personal height, reach and shaft lie angle $\alpha$ of the selected putter. Referring to FIG. 3 and FIG. 4, this adjustment is performed by manually rotating the side frame 24 until the guide bar 26 reaches the appropriate elevation for accommodating smooth, linear sliding movement of the putter shaft along the guide bar and the sole of the putter is maintained in parallel alignment with the putting surface during the execution of a practice putting stroke.

Each putter has a unique lie angle α and loft angle. The lie angle α is defined as the acute angle of the shaft 30 in relation to the sole 32 or bottom of the putter head 34. The loft of the putter face is defined as the angle between the club face and the vertical plane. A neutral loft generally has neither a positive nor a negative loft. The head 34 of the putter should be perpendicular to the stroke axis 28 so that the face of the putter is not open or closed in relation to the putting plane and target line. In order to present the club face squarely at the moment of stroke impact against the ball, the sole of the putter head should be in flush, parallel alignment with the putting surface. Preferably, the putter sole 32 makes momentary sweeping contact with the putting surface at the moment of impact. The putter shaft 30 swings through a pendulum arc in sliding contact along the guide bar 26.

Set-up is accomplished as shown in FIG. 3 and FIG. 4 as follows: The base frame 12 of the training aid 10 is placed on the putting surface 36 with the stroke axis 28 aimed toward a practice cup in alignment with the desired stroke trajectory or target line. A golf ball 38 is placed on the stroke axis 28, and the club face is set square to the ball with the club sole resting flush against the putting surface. The side frame slope angle ϕ is adjusted by manually rotating the side frame until the guide bar 26 is brought into engagement against the putter shaft 30. When this relationship has been established, the putter shaft 30 is properly inclined relative to the putting surface 36 at an angle equal to the lie angle α.

Under these set-up conditions, as a putting stroke is executed, the putter head 34 swings through a pendulum arc and the shaft 30 slides smoothly along the guide bar. At the moment of impact the putter sole 32 moves in parallel, flush alignment with the putting surface 36, making momentary sweeping surface contact against the putting surface. The face of the putter is oriented with a generally neutral loft (zero loft angle) at the moment of impact as the head 34 is stroked against the ball.

When the relationship shown in FIG. 3 is established, the slope angle of the putter shaft 30 relative to the putting surface is equal to the lie angle α of the selected putter, which may be a standard value or some unknown value. The training aid 10 can be set-up and used successfully without knowing the actual lie angle value of the selected putter.

Referring again to FIG. 3, the elevation of the guide bar 26 is adjusted and fixed at an operative guide position. In the set-up position, the base frame 12 is placed on a putting surface 36 and a golf ball 38 is placed on the longitudinal stroke axis 28. As the putter shaft 30 swings in linear sliding contact along the guide bar 26, the putter head moves through an arc, bringing the sole 32 of the putter in generally flat, sweeping contact along the putting surface 36 at the moment of impact. Under these conditions, the face of the putter will be oriented squarely and with a generally neutral loft as the head is stroked against the ball at the limit of down swing and onset of follow-through.

In the preferred embodiment, the guide bar 26 is marked with colored range bands 40, 42 (Red); 44, 46 (Blue); and 48, 50 (Yellow) for visually indicating back swing stroke range and follow-through stroke range. Preferably, the range bands are arranged in pairs of matching colors and are symmetrically disposed relative to a predetermined index line 52 that is centrally located on the guide bar 26. The index line 52 corresponds generally with the initial longitudinal placement location of the ball within the stroke window 22. The range bands are elongated strips of polyester film that are adhesively bonded onto the guide bar. Optionally, the range bands are painted on the guide bar.

Preferably, the outside base rail 16 is also marked with symmetrically disposed sets of range bands 54, 56 (Red); 58, 60 (Blue); and 62, 64 (Yellow) for visually indicating back swing stroke range and follow-through stroke range. In this embodiment, the range bands are disposed in pairs of matching color bands that are symmetrically arranged relative to a predetermined central location on the base rail (the gap 23) that corresponds generally with the initial longitudinal placement location of the ball 38 within the stroke window 22.

Referring again to FIG. 4, the training apparatus 10 assists a golfer 70 to control upper body movement, while avoiding hip rotation and hip sway so that energy stored in shoulder muscles during wind-up will be carefully controlled and accurately transmitted to the golf ball during the down swing and follow-through. Moreover, the training aid 10 helps the golfer to exercise and train upper body muscles during the execution of a square putting stroke, with smooth follow-through, so that good execution can be performed repeatedly as the muscular training effect is obtained and set-up mental imagery is reinforced by the images provided by the stroke window framework and the colored range bands.

Figure 7:
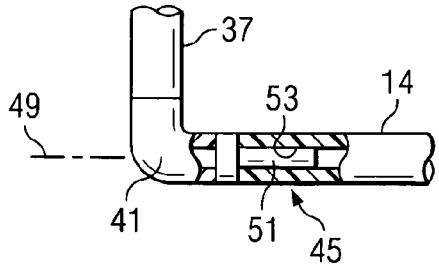
FIG. 7 is a fragmentary side elevation view, shown partly in section, of a rotary coupling member.

The training aid 10 in its preferred embodiment has a guide bar length dimension measuring approximately thirty-two inches in length. The lateral spacing separating the base rails 14, 16 is six inches. The guide bar 26 is supported by two riser bars 37, 39 each measuring eight inches in length. Each riser bar 37, 39 is terminated on one end by an elbow fitting 41, 43, respectively. The inside guide rail 14 is terminated on its opposite ends by rotary couplings 45, 47, respectively, which are connected to the elbow fittings. The rotary couplings allow the side frame to rotate in pivotal movement about the longitudinal axis 49 of the base rail 14. Each rotary coupling includes complementary male and female coupling members in the form of a pin 51 and socket 53 as shown in FIG. 7.

The pin 51 is received in frictional engagement against the sidewall of the socket 53. The pin and socket are finished with mating surfaces that are dimensioned for tight, continuous rubbing engagement, providing a level of static frictional resistance that opposes rotational movement of the side frame away from a desired operative position. The static frictional engagement can be overcome by medium hand pressure, allowing the slope and elevation of the side frame to be manually adjusted to accommodate a range of different putters. Optionally, the mating surfaces are finished with longitudinal ribs and grooves dimensioned for a snug, interlocking fit with incremental slip release.

The coupling members are press-fit together in a frictional union and the force of static frictional engagement is strong enough to maintain the desired side frame slope and guide bar elevation setting during putting practice, but can be adjusted by the application of medium hand pressure as may be needed from time-to-time. According to this arrangement, the slope angle ϕ of the side frame can be manually adjusted to raise or lower the guide bar 26 in elevation relative to the base frame 12.

In the preferred embodiment, all of the tubular components of the training aid 10 are sections of one-inch diameter, high density PVC tubing. Preferably, the base frame 12 and the side frame 24 are assembled from pre-cut sections of PVC tubing that are releasably connected together by pin and socket couplings and elbow fittings, as shown in FIG. 7. The releasable couplings and fittings permit the training aid 10 to be manually disassembled and carried in conventional travel luggage or in golf bags, and then quickly reassembled for practice.

Referring again to FIG. 1, FIG. 3 and FIG. 5, the cross bars 18, 20 are vertically offset relative to the base rails by riser stubs 72, 74 and 76, 78, thereby forming bridge openings 80, 82 overlying the stroke axis 28 and allowing rolling passage of a golf ball along the putting surface and through the bridge opening. Preferably, the bridge openings are formed over the opposite ends of the base frame 12 to accommodate use of the training aid 10 by left-handed as well as right-handed players.

Figure 5:
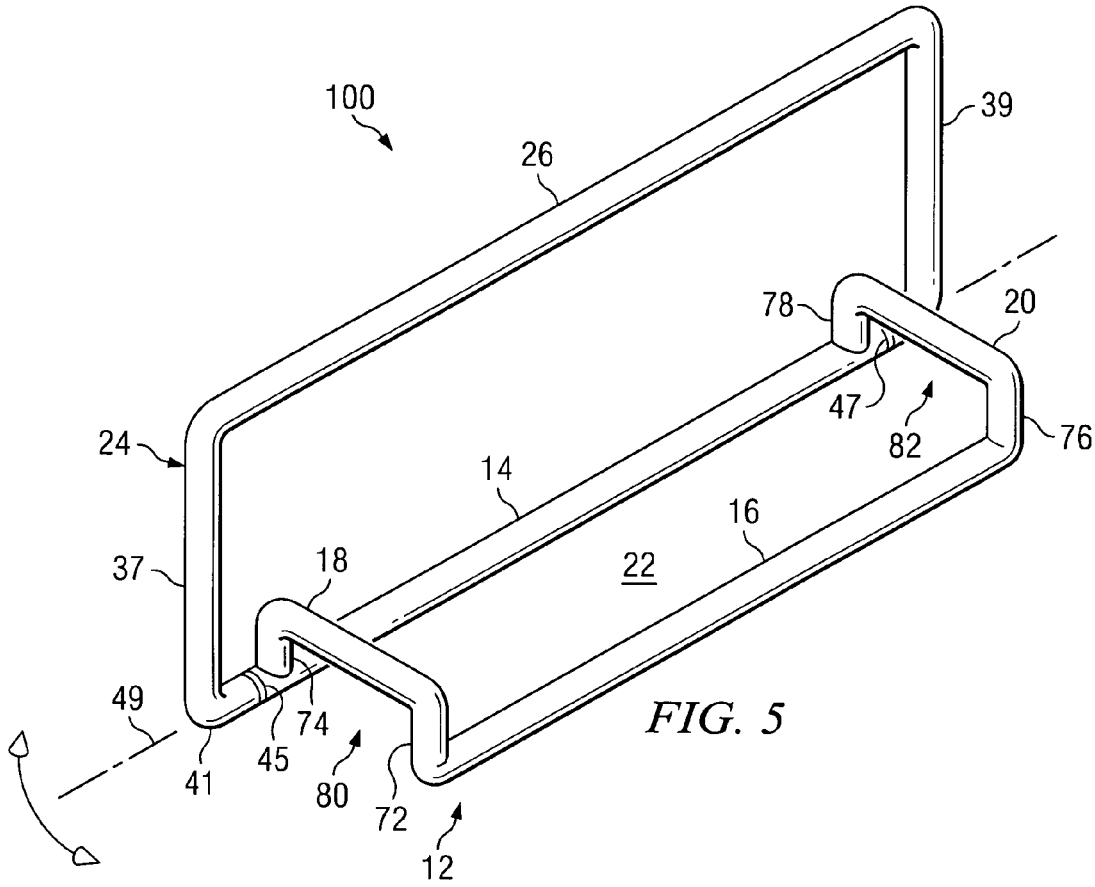
FIG. 5 is a perspective view, similar to FIG. 1, showing an alternative embodiment of the invention.

A putting practice and training aid 100 according to an alternative embodiment is illustrated in FIG. 5. In this embodiment, the outside base rail 16 is not bifurcated, and stroke range bands are not utilized. Otherwise, its construction is identical to that shown the preferred embodiment of FIG. 1.

Figure 6:
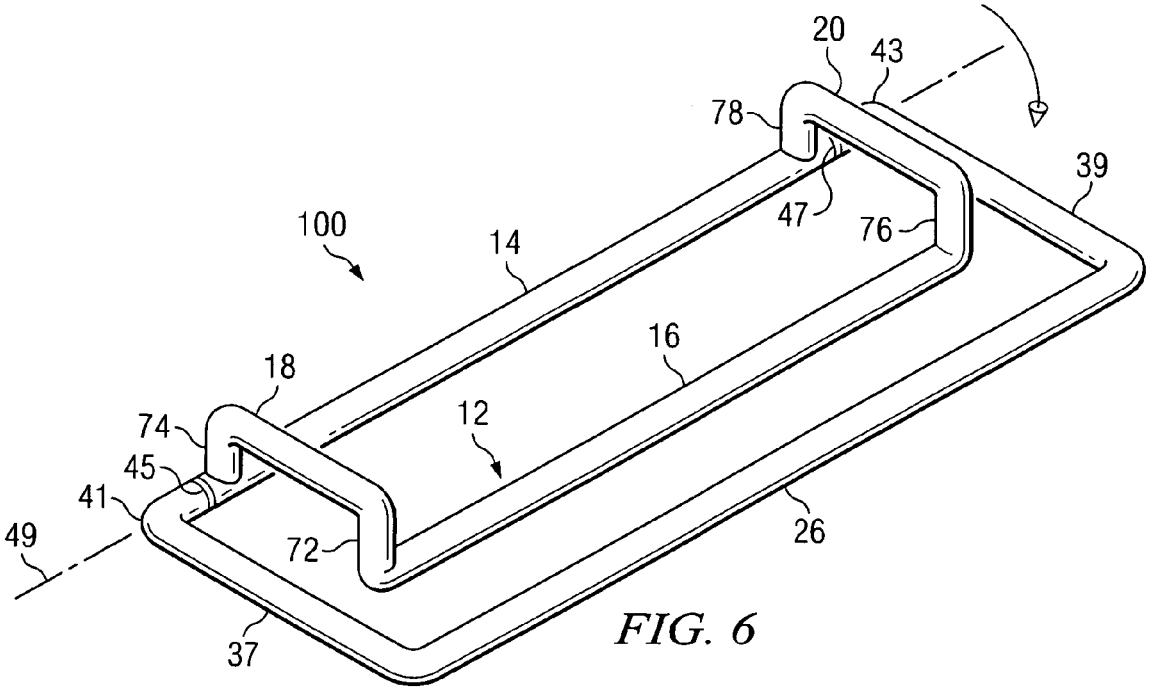
FIG. 6 is a perspective view of a golf practice and training aid according to one aspect of the invention in which the assembly is folded into its minimum profile, storage configuration.

During initial set-up for putting practice, the longitudinal axis 28 of the stroke window is aligned with the desired trajectory of the golf ball and the slope of the side frame 24 is manually adjusted to present the guide bar 26 at the appropriate elevation to accommodate the lie angle of the selected putter. After practice is concluded, the side frame is rotated and folded across the stroke window, thereby producing a minimum profile configuration for storage or transport, as shown in FIG. 6.

It will be understood by those skilled in the art that various modifications can be made to the illustrated embodiments without departing from the scope of the invention as described in the specification and hereafter defined in the appended claims.

We claim:

1. Golf practice and training apparatus for developing putting skills with a putter comprising, in combination:

a base frame engagable with and forming a border about a putting surface in an operative stroke practice position;

a guide bar coupled to the base frame for manually adjustable movement in elevation relative to the base frame;

the base frame including a plurality of parallel base rails and a plurality of cross bars, the base rails being spaced apart and held substantially in parallel alignment with a stroke axis by the cross bars, the plurality of base rails being engaged with a putting surface in the operative stroke practice position, the plurality of base rails being spaced to accommodate a head of the putter in the operative stroke practice position, and at least one of the plurality of cross bars being vertically offset by a pair of riser stubs integral therewith, the vertically offset being relative to the plurality of base rails engaged with the putting surface, thereby forming a bridge opening overlying the putting surface and allowing rolling passage of a golf ball along the putting surface and through the bridge opening; and one of the plurality of base rails engaged with the putting surface is intersected by a spacing gap that is large enough to permit lateral rolling movement of a golf ball onto a portion of a putting surface that is bordered by the base frame when it is placed in the operative stroke practice position.

2. Apparatus for guiding stroking movement of a putter, comprising:

a base frame engagable with and forming a border about a putting surface in an operative stroke practice position, the base frame including a base rail engaged with the putting surface, the base rail forming a boundary between the putting surface and a standby area adjacent the putting surface in the operative stroke practice position;

a side frame having a surface for engaging and guiding stroking movement of a putter shaft, the surface and the base rail defining a stroke window, the stroke window being sized to accent a head of the putter therein between the boundaries of the base rail and side frame during the stroking movement;

first and second rotary coupling apparatus connecting the side frame to the base frame, the rotary coupling apparatus enabling the side frame to be manually moved to an operative putting position and maintained at a sloping angle of inclination relative to the base frame; and the base rail is intersected by a spacing gap that is large enough to permit rolling movement of a golf ball from a standby area adjacent the putting surface to a stroke practice position on the putting surface.

* * * * *